United States Patent [19]

Gaynor et al.

[11] 3,937,572

[45] Feb. 10, 1976

[54] APPARATUS FOR INDUCTIVE ELECTROPHOTOGRAPHY

[75] Inventors: Joseph Gaynor, Arcadia; Terry G. Anderson, Pasadena; Walter Hines, Sierra Madre; Len A. Tyler, Pasadena, all of Calif.

[73] Assignee: Bell & Howell Company, Chicago, Ill.

[22] Filed: Feb. 25, 1974

[21] Appl. No.: 445,377

Related U.S. Application Data

[62] Division of Ser. No. 215,873, Jan. 6, 1972, Pat. No. 3,820,985.

[52] U.S. Cl. ..... 355/16; 96/1 R; 355/3 R

[51] Int. Cl.[2] ..... G03G 15/00

[58] Field of Search ..... 355/3 R, 3 DD, 16, 17, 355/4; 117/17.5; 96/1 R

[56] References Cited

UNITED STATES PATENTS

| | | | |
|---|---|---|---|
| 2,885,955 | 5/1959 | Vyverberg | 355/11 X |
| 3,013,878 | 12/1961 | Dessauer | 355/17 X |
| 3,551,146 | 12/1970 | Gundlach | 355/16 X |
| 3,722,992 | 3/1973 | Zweig | 355/16 X |
| 3,724,943 | 4/1973 | Draugelis et al. | 355/4 |
| 3,778,841 | 12/1973 | Gundlach et al. | 355/16 X |

*Primary Examiner*—Richard M. Sheer

*Attorney, Agent, or Firm*—Nilsson, Robbins, Bissell, Dalgarn & Berliner

[57] ABSTRACT

A thin insulative film is applied to be in direct contact with a surface carrying an electrostatic image which has a potential sufficient for adherence by induction of toner to the insulative film but insufficient to discharge when in contact with or upon separation of the toned insulative film. When the surface is photoconductive, it is exposed before or after contact with the insulative film to a pattern of discharging radiation to form an electrostatic image thereon. As one form of image development, toner is applied to the insulative film while in direct contact with the imaged surface. Thereafter, the toner image may be transferred to a support member. Toning and toner transfer is repeated without further charge and without further exposure.

8 Claims, 7 Drawing Figures

APPARATUS FOR INDUCTIVE ELECTROPHOTOGRAPHY

This is a division of application Ser. No. 215,873, filed Jan. 6, 1972, now U.S. Pat. No. 3,820,985.

FIELD OF THE INVENTION

The fields of art to which the invention pertains include the field of image forming processes and apparatus, more particularly processes and apparatus for electrostatic and inductive reproduction, and the fields of copying and duplicating in general.

BACKGROUND AND SUMMARY OF THE INVENTION

In a typical xerographic method for reproduction, electric charges are sprayed onto a photoconductive surface by means of a corona discharge. Following establishment of a uniform charge on the photoconductive surface, an image to be reproduced is formed by exposing the charged surface to a pattern of radiation to selectively discharge areas of the photoconductive surface thereby forming an electrostatic latent image. Thereafter, toner, which may be in the form of electrostatic powder, is applied directly to the photoconductive surface and adheres in the image regions through electrostatic attraction. The toner image is thereafter transferred from the photoconductive surface to a sheet of suitable material, such as paper, and fused thereto.

Apparatus utilizing the above image forming technique requires that the photoconductive layer be specially prepared to resist the abrasive effects of exposure to toner powder and operations associated with the application, transfer of the toner powder and removal of residual unwanted toner. These effects limit the useful life of the photoconductive medium and gradually degrade copy image quality. Furthermore, such machines do not produce multiple copies from a single exposure and particularly cannot produce multiple copies bearing two or more different colors.

Efforts to eliminate some of these drawbacks can be illustrated by reference to prior patents. For example, Dessauer U.S. Pat. No. 3,013,878 discloses the use of a flexible transfer material in the form of a continuous belt of insulating material applied to the surface of a photoconductive drum. The belt is uniformly charged and image-wise discharged so that an electrostatic image is formed on its surface. Thereafter, the belt is toned, separated from the drum and the toner image is transferred to a support sheet. The belt continues onto the photoconductive drum surface where it is again charged and selectively discharged for the production of further copies. Since the belt carries an electrostatic surface charge, only a single copy from a single exposure is possible.

Methods for preservation of the electrostatic image have been previously described, e.g., see "Xerography and Related Processes" by Dessauer and Clark, particularly section 14.4 relating to "Special Forms of Electrostatic Transfer" disclosing the use of a backing electrode for the copy paper as it is stripped from the photoconductive surface. Walkup U.S. Pat. No. 3,251,706 discloses an electrostatic process in which a copy sheet or web is applied to a photoconductive surface after formation of an electrostatic image thereon. Toner is applied to the copy sheet and, after the sheet is removed from the photoconductive surface, the toner is fused to the sheet. The photoconductive surface retains the xerographic electrostatic latent image. If paper is utilized for the final copy, it has sufficient lateral conductivity to cause image spread resulting in low quality reproduction. To overcome this drawback the patentees advocate maintaining a small spacing between the paper and the electrostatic image surface which, however, results in a decrease in density and resolution unacceptable by current standards.

The prior art has also appreciated that the surface of a photoconductive member can be protected by an insulating film, e.g., Butterfield U.S. Pat. No. 2,693,416, and various prior patents have disclosed the use of an insulative film integrally bound to a photoconductive surface, e.g., Schlein et al. U.S. Pat. No. 3,537,786 and Walkup U.S. Pat. No. 2,934,649. In Schlein et al., the patentees recognized the deficiencies of xerographic processes and utilized as the latent image storage means a medium capable of being internally polarized and which relies on the phenomenon known as "Persistent Internal Polarization." Other patents of interest herein include U.S. Pat. Nos. 62,044, 1,552,788, 1,706,182, 1,723,206, 1,784,912, 1,956,820, 2,221,776, 2,297,691, 2,357,809, 2,368,648, 2,618,551, 2,618,552, 2,624,652, 2,633,796, 2,732,775, 2,756,676, 2,811,465, 2,812,709, 2,825,814, 2,833,648, 2,975,052, 3,084,061, 3,128,683, 3,234,019, 3,254,998, 3,355,289, 3,429,701, 3,438,772 and 3,458,310.

The present invention provides an electrostatic process which overcomes the foregoing drawbacks and which enables the production of a plurality of copies on "plain" copy paper. The process also permits the production of full color reproduction in which two, three or more toner colors are overlayed onto a single copy sheet. Inexpensive photoconductive materials can be used, such as zinc oxide, as well as the traditional selenium or cadmium sulfide surfaces. In certain embodiments an insulative, non-photoconductive surface may be used. Importantly, the image carrying surface is completely protected from the abrasive effects of toner application and therefore has an extremely long lifetime. In broader terms, any means for developing the image such as differential melting, dimpling by heat, and the like, may be used.

The present invention utilizes inductive electrophotography in which an insulating film overlies an electrostatic image carrying surface and involves a unique combination of insulating film properties, charging levels and other process conditions to develop an image, as with toner or otherwise, while retaining an electrostatic latent image on the image carrying surface. In prior art processes, when toner is deposited directly on the charged photoconductor surface, some charge is lost directly to the toner. The interposition of a thin insulating film as described below, prevents loss of charge. In accordance with the present invention, a thin insulative member, such as a plastic film, is applied in direct contact with an insulative surface which may be photoconductive and which may be adapted for having an electrostatic image formed thereon. When using a photoconductive surface, it is initially electrostatically charged to a predetermined potential which is sufficient to effect development of an image on the insulating film but which is insufficient to discharge when the image is removed from the photoconductive surface. Before or after application of the insulating film the charged photoconductive surface is exposed to a pattern of radiation to form a latent electrostatic image of the pattern on the photoconductive surface. When using a non-photoconductive insulative surface, an electrostatic image is placed directly thereon by means of an electron beam or by a charged stylus, or the like. If toner is used as the developing agent, it can be applied while one surface of the insulating film is in direct contact with the image carrying surface, adhering to the opposite surface by induction. Thereafter, the toner may be transferred and this can occur while the insulating film is in contact with the photoconductive surface. Preferably, the insulating film is separated from the image carrying surface and the toner image is fused to the film or is transferred to a support member, such as copy paper, and then fused to the paper. Since the electrical field at the image carrying surface is insufficient to cause discharge upon separation of the insulating film, the latent image can be reused by reapplying the same insulating film or by applying a fresh length of insulating film. Neither further charging nor further exposure is required to produce another toner image on the free surface of the insulating film.

The insulating film can be in the form of a closed loop and the image carrying surface carried by a drum so that a plurality of copies can be continuously formed. If the circumference of the drum is equal to the length of one document, copies are produced continuously as the drum rotates and the endless loop continues to advance. If the drum circumference has a length equivalent to a plurality of documents, or if a belt or other suitable configuration of the image carrying medium is provided having such length, after one charge and exposure for each page, copies of a document of plural pages are produced in sequence. In a further embodiment where the drum surface is three or four documents long, exposure of each segment can be effected with successively different wavelengths of radiation and a different colored toner applied to each segment of insulating film in synchronization with rotation of the drum. The same copy sheet is repeatedly brought into successive contact with each segment for successive transfer of the differently colored toner images to a single sheet to thereby provide a full color reproduction of the document. Alternatively, the insulating film can constitute the final copy which may be either transparent or opaque. The thin insulating film can be laminated to another material for support and/or to protect the image.

As above indicated, certain parameters are critically important to operation of the processes of this invention, their combination yielding high quality copies which would otherwise not be produced. The thin insulating film should be a good electrical insulator, and be smooth, uniform and thin. Additionally, for reuse, the film should be dimensionally stable, highly abrasion and wear resistant and thermally stable. It is critical that the film be in intimate contact with the image carrying surface so that there is virtually no space between the insulating film and photoconductive surface. The insulating film should have high lateral electrical resistivity to prevent image spread, at least about $10^{13}$ ohms/□ of surface, and a maximum thickness of about 3.0 mils, preferably about 1.5 mils, to allow acceptable resolution and density of the toner image. Films as thin as 0.1 mil, preferably 0.25 mil, can be employed, although no minimum thickness need be specified. Additionally, the potential to which the photoconductor is charged should be insufficient to initiate charge transfer or discharge between the image carrying surface and the thin insulating film, generally about 800 volts. See, in this regard, *Electrophotography* by R. M. Schaffert, Focal Press, London, New York, 1965. Since the insulating film is never charged, except by induction, and the electrically imaged surface itself is not developed, the electrostatic image will not be removed. However, with photoconductors, their inherent decay characteristics will result in eventual dissipation. Accordingly, a photoconductive material should be selected having a decay rate sufficiently low to produce the number of copies desired. Photoconductive media composed of sensitized photoconductive particles dispersed in a polymeric matrix can be controlled to give extremely low decay rates, as can evaporated amorphous selenium, enabling the production of a multiplicity of high quality copies.

For purposes of simplicity of description, the following detailed description of the invention refers specifically to image development with dry toner. However, it will be appreciated that liquid toner application is fully equivalent and that in many embodiments other known methods for electrostatic image development can be substituted directly or with only minor modification, all well within the skill of the art.

DETAILED DESCRIPTION

Figure 1:
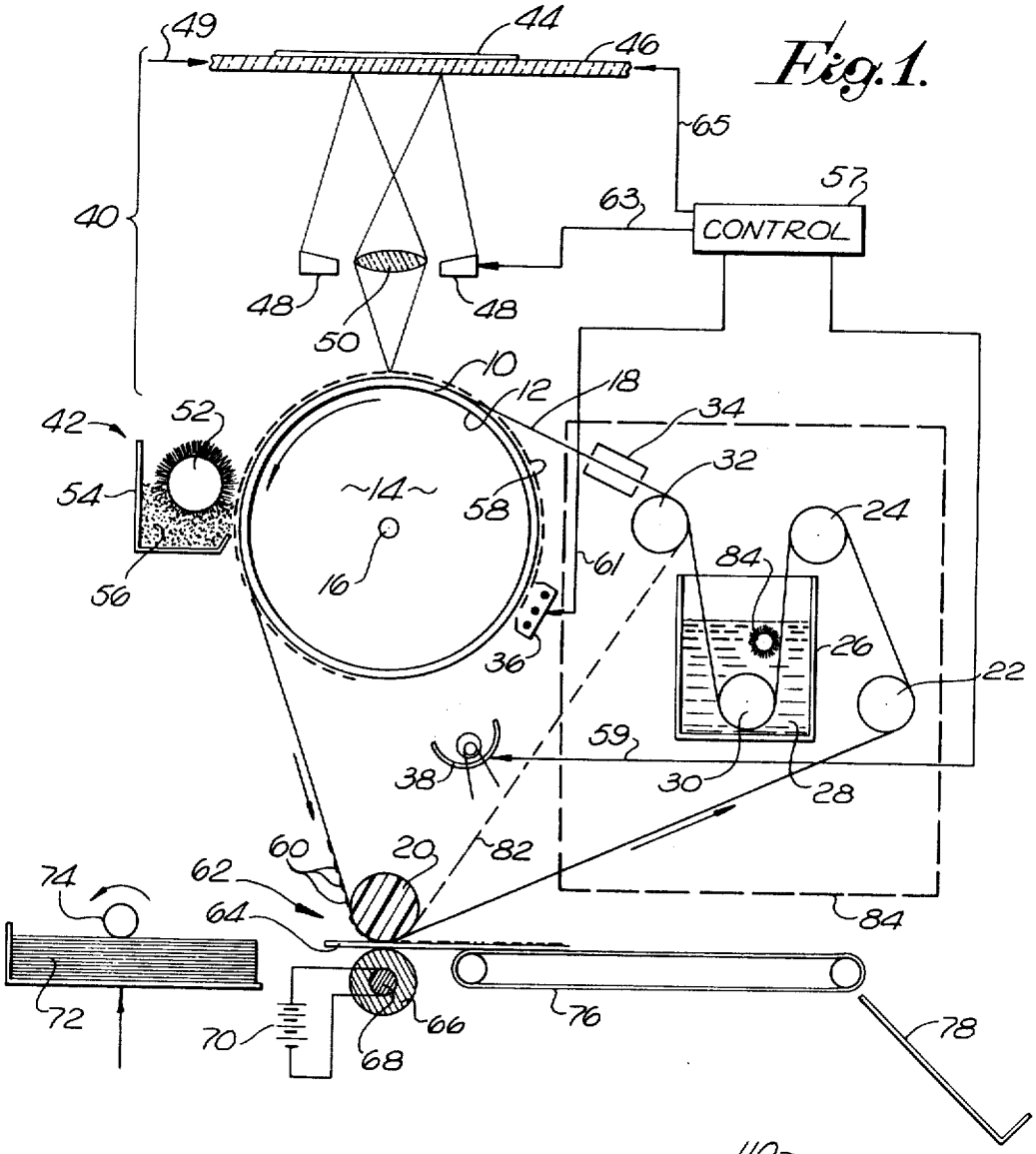
FIG. 1 is a diagrammatic view of a mechanism for accomplishing one embodiment of the invention.

Referring to FIG. 1, one embodiment of the invention is illustrated. The drawing is schematic and serves to illustrate the process steps. Therefore, relative sizes and positions are not to be taken literally but are used as convenient to ease of illustration. In this regard, the toner transfer station is shown in the drawing as vertically spaced a substantial distance from the photoconductive drum surface, whereas in actual construction it would be located as close to the drum as practical and vertical runs eliminated. Alternatively, the toner can be transferred without removal of the thin insulating film from the drum.

A xerographic plate having a photoconductive surface 10 and a conductive backing 12 is arranged in the form of a cylindrical drum 14. However, the invention also contemplates the use of flat photoconductive surfaces, such as zinc oxide paper, or other configuration. The drum 14 is mounted for rotation on a shaft 16 that is rotated at a predetermined speed by suitable motive means (not shown). An endless belt 18 of light transmitting material, which will be described hereinafter in more detail, is overlaid on a portion of photoconductive surface 10 and is held in direct close contact with the photoconductive surface 10 by means of suitable tensioning means (not shown) operative with various rollers as required for subsequent operations. In this particular configuration, the belt 18 is led over a rubber transfer roller 20 and from there to a pair of idler rollers 22 and 24 into a tank 26 containing a cleaning liquid 28, as hereinafter described, onto an idler roller 30 within the tank and from there over an idler roller 32, past a heater 34 and back onto the photoconductive surface 10 of the drum 14. The drum 14 and belt 18 travel in a counterclockwise direction and a corona charging grid 36 is disposed adjacent the photoconductive surface 10 at a point prior to its contact with the belt 18. A discharge lamp 38 is disposed at a position prior to the disposition of the corona charging grid 36 and subsequent to separation of the belt 18 from the photoconductive surface 10, all with respect to the direction of travel of the belt 18 and drum 14. A document exposure station 40 is disposed to overlie a contact region of the belt 18 and photoconductive surface 10 and is followed in the course of travel of the drum by a toning station 42 which is also disposed adjacent a contact region between the belt 18 and photoconductive surface 10.

In many respects the foregoing apparatus is similar to mechanisms well known to the prior art and in particular the exposure station 40 is constructed in accordance with any of a number of various types of exposure stations utilizing direct exposure through a document, reflection exposure utilizing mirrors or counterdirected exposure lamps, image forming lenses, inversion lenses, and the like as appropriate to a particular configuration as might be desired, and such components do not form a part of the present invention as such. In the particular embodiment illustrated, a document 44 to be reproduced is placed face down on a glass plate support 46 and illumination lamps 48 are disposed beneath the plate 46 to direct exposure radiation through the plate 46 against the document 44. The radiation is reflected downwardly through an appropriate lens 50 and from there onto a region of contact between the photoconductive surface 10 and belt 18. The plate support 46 is movable, as indicated by the arrow 49, in the opposite direction to travel of the drum (or the same direction with an appropriate speed differential) to expose the drum surface to the entire document. The toning station 42 can have any prior art configuration, and it is found advantageous to utilize a magnetic brush 52 which is operative with a bin 54 carrying a supply of toner particles 56 closely adjacent a contact region between the photoconductive surface 10 and belt 18.

In prior mechanisms, the photoconductive drum surface 10 is uniformly charged by means of the corona charging grid 36 and is thereafter directly exposed and toned, toner particles adhering directly to the photoconductive surface. Thereafter, the toner particles are transferred to a paper sheet or the like. The photoconductive surface is then recharged, exposed to a different document, or the same document, and again toned and the toner again transferred. The present mechanism differs from prior mechanisms in that once the photoconductive drum surface 10 is charged and exposed, it need not thereafter be charged or exposed until it is desired to reproduce a different document. The counterclockwise movement of the drum and belt continues without further charge and exposure, but with subsequent toning and toner transfer steps so as to produce a plurality of images from a single charge and exposure. Thereafter, when it is desired to copy a different document, the discharge lamp 38 is activated to blanket expose the drum surface and the charging grid 36 and exposure station 40 are again actuated.

Referring to the operation of the mechanism in more detail, a control unit 57 is provided which serves to synchronize operation of the discharge lamp 38, corona charging grid 36 and exposure station 40, as indicated by the arrows 59, 61, 63 and 65, respectively, to deactivate these components after the initial exposure and activate them again after the desired number of copies have been produced and it is desired to reproduce a different document. Alternatively, where the circumference of the drum is equal in length to a plurality of documents 44, the control unit 57 deactivates the charging grid 36 and exposure lamps 48 after such a plurality of exposures have been made. Initially, the corona charging grid 36 is actuated to place a uniform electrical charge over the entire photoconductive surface 10. The photoconductive surface 10 can be charged negatively, as indicated at 58 by the negative signs, or it may be charged positively, depending on the photoconductor, all as well known. As the drum and belt rotate, the charged photoconductive surface 10 is brought into intimate direct contact with the belt 18 and while in such contact rotates past the exposure station 40. The exposure station is actuated so as to illuminate the photoconductive surface 10 through the belt 18, dissipating charges at exposed regions, as well known to the art, thereby imparting a pattern of charges as a latent image of the document to be reproduced. As the drum 14 and belt 18 rotate past the exposure station, the exposed region is contacted by the magnetic toner brush 52 which deposits particles of toner onto the surface of the belt 18 immediately overlying the latent electrostatic image. Any commercially available toner particles can be employed. The toner is attracted to the belt 18 as a result of induced electrostatic forces through the belt and forms a toner image of the document on the belt 18. The belt 18 can be then separated from the drum surface 10 and may be led with its toner image, as indicated at 60, to a toner transfer station 62.

At the image transfer station 62, the conductive roller 20 compresses the toner bearing belt 18 into contact with a support sheet 64 which is sandwiched between the belt 18 and a metallic roller 66. The support sheet 64 can be a paper sheet or any desired support member to which a toner image will adhere. The metal roller 66 is formed with an axially central heating rod 68, heated by means of a power source shown diagrammatically at 70, so that heat is applied through the support sheet 64 to fuse the toner thereto. The support sheet 64 is fed from a supply 72 thereof by means of a pressure roller 74 actuated in registration with travel of the belt 18 by a mechanism not shown. As the toner image is transferred, the support sheet 64 passes onto a conveyer belt 76 and from there into a receptacle 78.

Following the foregoing operation, the belt 18 and drum 14 continue to rotate bringing the previously toned portion of the belt 18 back into engagement with the photoconductive drum surface 10. Since the discharge lamp 38 and corona charging grid 36 have been deactivated, the photoconductive surface 10 retains the electrostatic latent image and as the belt and drum are rotated in contact past the toner station 42, the toner 56 is again applied to the belt 18, adhering to the belt 18 as before as a result of induced electrostatic forces from the latent electrostatic image on the photoconductive surface 10. Thereafter, as the belt passes through the toner transfer station 62, another copy of the document 44 is obtained by transfer of toner from the belt 18 to another support sheet.

The foregoing process can be repeated a plurality of times limited only by dissipation of the electrostatic latent image on the photoconductive surface in accordance with the dark decay rate of the photoconductive surface. Photoconductive material can be utilized in which sensitized photoconductive particles are dispersed in a polymeric matrix to give extremely low dark decay rates. For example, about 80 weight percent of photoconductive zinc oxide can be dispersed in a silicone resin sold under the trademark SR-82 and coated as a layer on a drum and will have sufficiently low dark decay rate to enable the reproduction of about 20–50 copies of good quality from a single exposure. Specific compositions and dark decay rates are well known and reference can be made to prior issued patents such as cited above.

When it is desired to copy a different document, the discharge lamp 38 and corona charging grid 36 are sequentially actuated by the control, the exposure lamp 38 blanket exposing the photoconductive surface 10 to remove the electrostatic latent image and the corona charging unit 36 placing a uniform electrostatic charge over the photoconductive drum surface. The control thereafter actuates the document exposure lamp 48 to form an electrostatic latent image of the new document through the belt 18 onto the photoconductive surface 10.

As hereinabove indicated, it is critically important to have the potential to which the photoconductor is charged be limited to a voltage level which is insufficient to initiate charge transfer or discharge between the photoconductive surface 10 and the insulating belt 18. The maximum potential across the photoconductive layer which will avoid charge transfer to the belt 18 depends upon the relative capacitances of the photoconductive layer and the belt 18, which forms a capacitive voltage divider. Furthermore, it is critical that the insulating belt 18 be maintained in intimate contact with the photoconductive surface 10, have a high lateral electrical resistivity, at least $10^{13}$ ohms/□ of surface, to prevent image spread and have a maximum thickness of about 3 mils so as to enable satisfactory resolution and density of toner image. Exemplary materials include thin insulating films formed of polycarbonates, polyphenylene oxides, polysulfones, Mylar (a transparent polyethylene terephthalate polyester film), polypropylene, Teflon (a polyfluoro hydrocarbon), Kapton (a polyimide), polyethylene, and the like. In the illustrated embodiment wherein image-wise exposure is through the insulative belt 18, the belt 18 should be transparent at least to the imaging radiations. However, color separation images can be provided by forming adjacent sections of the belt 18 with different separation colors and this is particularly useful when the photoconductive surface 10 has an effective length equal to three or four documents. The toner images can be overlaid to yield a composite, full color image. Alternatively, the successive images can be transferred to a single transparent or opaque sheet utilizing a toner transfer mechanism as will be described hereinafter with respect to FIG. 4.

Alternatively, in place of a toner transfer station 62, one can employ a non-resuable belt of thin insulating film and lead the toned film to a fusion station whereat the toner is fused to the insulating film to form a final, permanent copy.

It will also be appreciated that the principles of this invention are applicable to the preparation of images utilizing a flat photoconductive surface and/or the utilization of a consumable insulative film. In the latter case, the insulative film can be fed from a supply roller and taken up by a take up roller and thereafter discarded or reused. Such a configuration can be utilized with either a flat photoconductive surface or a drum surface. The cost of the thin insulative film is sufficiently small as to make such consumption a practicality.

Depending upon the particularities of the thin insulating film 18, toner particles 56 and method of toner transfer, alternative embodiments being described hereinafter, the insulating film 18 may or may not need to be subjected to a cleaning step. In most cases of operation, utilizing for example a Mylar belt and toner transfer as shown, the belt 18 can be reapplied without any cleaning step, in which case the belt 18 can be led directly over the idler roller 32, bypassing the tank 26, as shown by the dashed line 82. In such case, the heater 34 would be disconnected. If it is desired to clean the belt 18, it is simply led into the cleaning tank 26 whereupon it is contacted with a cleaning liquid such as Freon TA. The cleaning liquid may be conductive so as to dissipate random electrostatic charges which may be present on the belt 18. A small rotating brush 84 is supported within the conductive liquid 28 in contact with the toner carrying surface of the belt 18 to aid in dislodging any toner which may have remained adhered to the belt 18.

Figure 2:
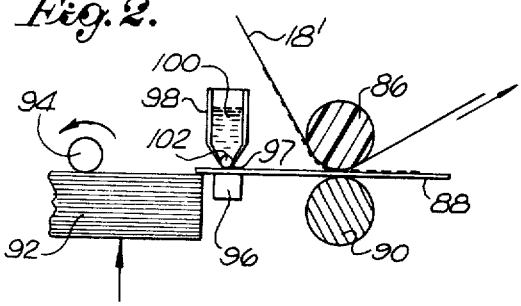
FIG. 2 is a diagrammatic view of an alternate toner transfer mechanism.

Referring now to FIG. 2, there is diagrammatically illustrated an alternative toner transfer mechanism wherein the copy paper is slightly wetted by a toner transfer solvent and thereafter brought into contact with the toned belt surface. The belt 18' is led from the toning station 42 and pressed by a rubber roller 86 into contact with a copy sheet 88 against a metal roller 90. The copy sheet 88 is fed from a supply 92 thereof by means of a feed roller 94 rotating in synchronization with travel of the belt 18'. As the copy sheet 88 is fed toward the belt 18', it passes between a platen 96 and an opening 97 in a solvent supply tank 98 containing a solvent 100. The solvent 100 is released via a check ball 102 to lightly wet the top surface of the copy sheet 88. The relative disposition of the solvent tank 98 and platen 96 can be adjusted by a mechanism not shown to adjust the amount of wetting. As solvent one can utilize acetone, tetrahydrofuran, methylene chloride, or the like. The toner adheres to the wetted copy sheet 88 as it passes into contact with the belt 18. The solvent is sufficiently volatile to completely dry while being conveyed via the conveyer belt 76 to the bin 78.

Figure 3:
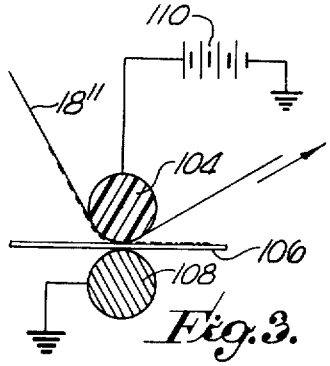
FIG. 3 is a diagrammatic view of another alternative toner transfer mechanism.

Referring now to FIG. 3, another alternative toner transfer mechanism is illustrated wherein the toned belt 18'' is led from the toning station 42 and pressed by a conductive rubber roller 104 into contact with a copy sheet 106, fed from a supply not shown, against a grounded metal roller 108. A potential is established between the conductive rubber roller 104 and metal roller 108 by a voltage source 110 and ground connections, the voltage source 110 and roller ground being connected by brushes not shown. A positive voltage is applied to the conductive rubber roller 104 to repel the positively charged toner particles onto the copy sheet 106. Thereafter the toner particles are fused to the copy sheet 106 by passage through a heater, not shown.

Figure 4:
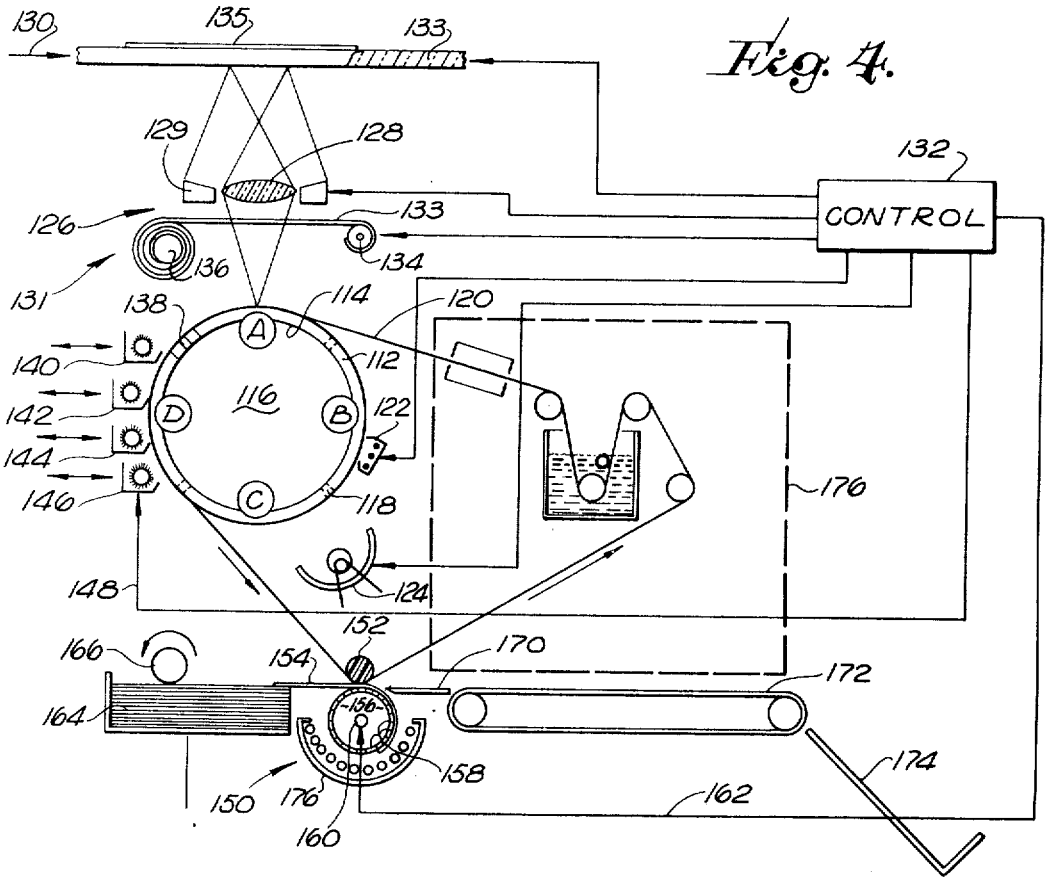
FIG. 4 is a diagrammatic view of a mechanism for accomplishing an alternative embodiment of the invention wherein a plural colored copy is produced.
Figure 7:
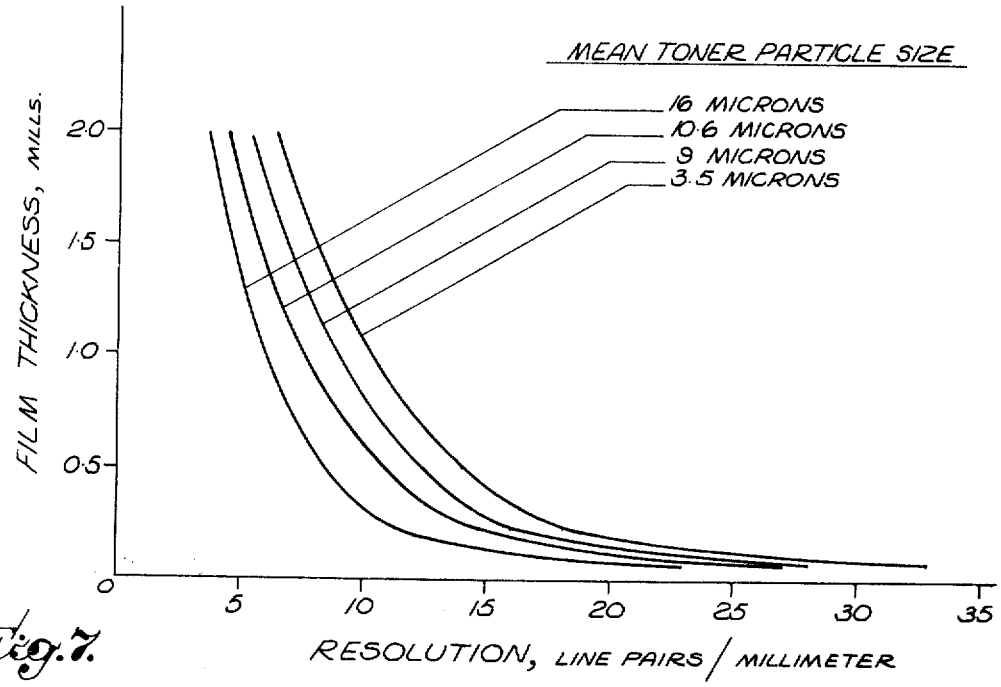
FIG. 7 is a set of curves relating film thickness and mean toner particle size to resolution.

Referring now to FIG. 4, there is illustrated a mechanism in diagrammatic form for applying successive different colored toner images onto a single copy sheet. A photoconductive surface 112 is carried on the conductive backing 114 of a rotatable drum 116, the photoconductive surface 112 having a circumferential length slightly greater than four times the length of a document (not shown) to be reproduced. These lengths are indicated schematically by the segments labeled A, B, C and D and separated by marginal regions, such as at 118, which need not be actual physical separations but are shown by dashed lines to demarcate separate lengths corresponding to document lengths. A thin, transparent insulating film in the form of an endless loop or belt 120 is applied to the drum in a manner which may be identical with the application of the belt 18 to the drum 14 as illustrated in FIG. 1. The drum 116 and belt 120 rotate counterclockwise in registration in the same manner as described in FIG. 1 so that a uniform electrostatic charge can be placed on the surface of the photoconductive layer 112 by a corona charging grid 122 and erased by a discharge lamp 124.

Following the application of a uniform charge, the photoconductive surface 112 is rotated into close contact with the belt 120 so that region A enters an exposure station 126. At the exposure station, image forming radiation from exposure lamps 129 passes through associated lenses, indicated at 128. A support plate 133, for a document 135 to be copied, is movable as indicated by arrow 130 in synchronization with rotation of drum 116, which, with the lamp 128, is regulated by a control unit 132, as described with respect to the similar mechanism in FIG. 1. The imaging radiation then passes through a selective color absorber 131 and through the belt 120 to impinge onto the photoconductive surface 112, selectively discharging the photoconductive surface 112 in the region A in accordance with the image pattern. The color absorber 133 is shown diagrammatically as a sheet 133 of plastic film, such as Mylar, coated with color absorbing dye and fed from a feed roller 134 to a take up roller 136. The filter sheet 133 is formed with successively adjacent differently colored portions in correspondence to well known color separation criteria, each portion having a length corresponding to a document length and marginal region 118. The sheet 133 is formed with a leader which is followed by an initial transparent portion so as to provide a background black image. The next succeeding portion transmits red light followed by a portion which transmits yellow light and followed by a portion adjacent a trailer which transmits blue light. The feed and take up rollers 134 and 136 are actuated by the control 132 so that after the last, blue-transmitting portion has passed the exposure station 126, the sheet 133 is rapidly rewound for the next copy. In this regard, the marginal distance between the last photoconductive region D and the first photoconductive region A, as indicated at 138, is sufficiently large to accommodate a rapid rewinding of the color separation sheet 133. Other exposure mechanisms and color separation mechanisms can be utilized as desired, the foregoing mechanism illustrating only a particular means for accomplishing color separation. For example, as previously indicated, the belt 120 can itself be formed of successively differently absorbing portions. In such case, the length of the belt 120 would be a multiple of the circumferential length of the drum, a multiple of two being convenient to accommodate the corona charging grid 122 and discharge lamp 124.

As the drum 116 and belt 120 rotate past the exposure station 126, a selected one of a plurality of toner applicators 140, 142, 144 and 146 is brought into operative association with the belt 122 so that the toner contained therein can be applied to the belt 120 by inductive electrostatic attraction. The toner applicators 140, 142, 144 and 146 are movable into and out of operational contact with the belt 120, as indicated by the arrows, in accordance with a selection signal generated by the control 132 as indicated by the line 148. The toner applicators contain differently colored toners in accordance to the color of exposure radiation passing through the filter sheet 133 and their actuation is selected by the control unit 132. For example, the toner applicator 140 contains black toner particles and is applied to the belt 120 overlying the exposed photoconductor surface region A.

After exposure of the region A, the control unit 132 causes a further exposure of the region B through the next succeeding portion of the exposure sheet 133, followed by exposures of regions C and D through successive filter sheet portions. Toner applicators 142, 144 and 146 contain respectively red, green and blue toner particles and are successively applied to the belt 120 as the successive regions B, C and D are rotated with the belt past their respective locations.

After the belt 120 carrying the toner particles from the applicator 140 is separated from the photoconductive surface 112, it passes to a toner transfer station 150 where it is pressed by means of a rubber roller 152 into contact with a copy sheet 154 against the outer surface of a transfer drum 156. The transfer drum is formed generally hollow with a plurality of openings 158 through its surface. A vacuum source, indicated at 160, is applied interiorly of the drum 156 to cause adherence of the copy sheet 154 to the surface of the drum 156. The vacuum source 160 is then actuated by the control unit 132 as indicated by the line 162 as the copy sheet 154 is fed from a supply 164 thereof. The copy sheets are supplied by any mechanism known to the art, e.g., a gripping roller 166 and which rotates in registration with the drum 116 so that a copy sheet 154 is fed once for each complete rotation of the drum 116. The vacuum source 160 is maintained operative until the last toner image, representing the latent image on photoconductive region D, is transferred to the copy sheet 154. Thereafter, the control unit 132 opens the drum 156 to atmospheric pressure, allowing the belt 120 to carry the copy sheet onto a bridging platen 170 and from there on to a conveyor belt 172 to deposit the copy in a receptacle 174. During rotation of the copy sheet 154 the toner images are fused to the surface by means of a curved heater element 176. The result is a full color copy of the original document.

After a complete rotation of the drum 116, rotation thereof is continued without further charging of the surface and without further exposure, the successive regions A, B, C and D retaining the color-selected electrostatic latent images which can be utilized by recontact with the insulative belt to form a plurality of full color copies of the document. When it is desired to duplicate a different document. the control 132 successively actuates the discharge lamp 124, corona charging unit 122 and exposure lamp assembly 126.

If desired, a belt cleaning station 176 can be provided which is identical to the components described with respect to FIG. 1.

Figure 5:
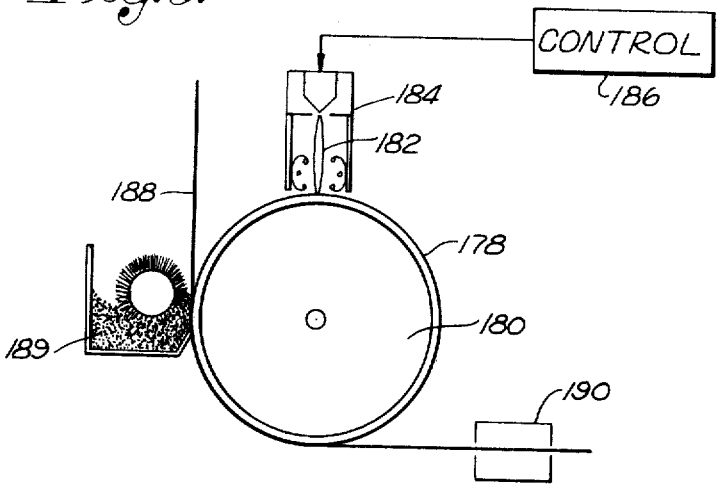
FIG. 5 is a diagrammatic, partial view of a mechanism utilizing an electron beam to provide an electrostatic image.

Referring now to FIG. 5, there is illustrated still another embodiment wherein in place of a photoconductive surface, one uses a surface 178 of insulative material, which for convenience, can be carried by a drum 180. An electrostatic image as desired is placed on the insulative surface 178 by means of an electron beam 182 generated by any mechanism 184 as known to the prior art as determined by a control 186. The drum 180 rotates the surface 178 into close contact with a belt 188 of thin insulative material which may be identical with the belt 18 of FIG. 1, but need not be transparent. Toner 189 is applied to the belt 188 and transferred in a manner as described with respect to FIG. 1. In this embodiment, the belt 188 is shown as consumable and as carrying an image fused thereon by heater 190.

Figure 6:
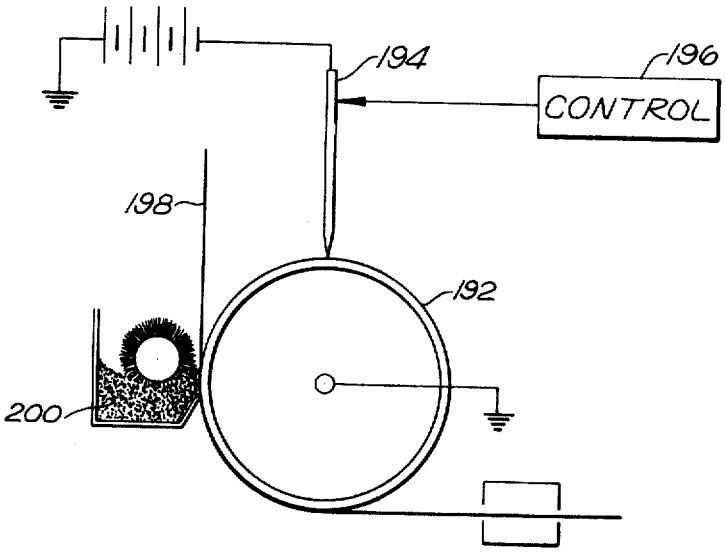
FIG. 6 is a diagrammatic, partial view of a mechanism utilizing a charged stylus to provide an electrostatic image.

Referring to FIG. 6, there is illustrated an embodiment wherein an electrostatic image as desired is placed on a surface 192 of insulative material by means of a charged stylus 194 as determined by a control 196. The surface 192 is rotated into close contact with a belt 198 of thin insulative film and toner 200 is applied and transferred as referred to with respect to FIG. 5.

As previously indicated it is important to maintain certain interrelationships between the properties of the insulative film and toner. The following examples will illustrate such relationship.

EXAMPLE 1

Commercially available zinc oxide paper was charged negatively with a commercially available corona charging unit to a dark potential of 550 volts and selectively, image-wise discharged by light exposure. A sheet of 0.5 mil smooth Mylar was placed in intimate contact on the zinc oxide sheet. The Mylar sheet was toned with Hunt 67-146F toner having a mean particle size of about 9 microns, employing a hand-held magnetic brush toner applicator, which also served to assure close, intimate contact of the Mylar sheet and zinc oxide paper. In order to determine resolution, the toner was fused to the Mylar sheet by heating on a hot plate at about 125°C for a few seconds to yield a copy having a resolution of about 13 line pairs per millimeter.

EXAMPLES 2–4

The procedure of Example 1 was repeated but utilizing respectively 2 mils, 1 mil and 0.25 mil Mylar, respectively, to obtain resolution of about 5, 9 and 16 line pairs per millimeter respectively.

EXAMPLES 5–8

The procedure of Example 1 was followed except that Bruning toner having a mean particle size of 10.6 microns was utilized on 2 mils, 1 mil, 0.5 mil and 0.25 mil Mylar, respectively, to obtain copies having resolutions of 4, 6, 9 and 16 line pairs per millimeter.

EXAMPLES 9–12

The procedure of Example 1 was followed except that Hunt 67–146 toner, having a mean particle size of about 16 microns, was utilized on 2 mils, 1 mil, 0.5 mil and 0.25 mil Mylar, respectively, to obtain copies having resolutions of 4.5, 7, 9 and 11.3 line pairs per millimeter, respectively.

EXAMPLES 13–16

The procedure of Example 1 was followed except that a modified zinc oxide paper (which accepts positive charges) was employed and a positive charge was applied with the corona charging unit. Xerox microxerographic toner, having a mean particle size of about 3.5 microns was applied with a powder cloud developer on 2 mils, 1 mil, 0.5 mil and 0.25 mil Mylar to obtain copies having resolutions of about 7, 11, 14 and 18 line pairs per millimeter, respectively.

EXAMPLES 17 AND 18

The procedure of Example 1 was followed except that 2 mils and 1 mil General Electric Lexan (a polycarbonate) was utilized to obtain copies having resolutions of 5 and 10 line pairs per millimeter, respectively.

Referring to FIG. 5, there is illustrated the relationship between film thickness, toner particle size and resolution obtained with a large number of duplications utilizing the procedures of the foregoing examples. It will be seen that a significant relationship is demonstrated between toner particle size, insulative film thickness and resolution.

As required, details of illustrative embodiments of the invention have been disclosed herein. However, it is to be understood that these embodiments merely exemplify the invention which may take forms different from the specific illustrative embodiments disclosed. Therefore, specific structural and functional details, except where so specified, are not necessarily to be interpreted as limiting, but merely as a basis for the claims. In this regard, the devices illustrated in the figures contemplate re-use of the thin insulating film component, but the invention also contemplates single use methods wherein the insulating film is merely discarded, or wherein the toner image is fused to the insulating film. Such toner-fused films can be employed to copy images obtained from a microfilm reader-printer. The film can be used directly as transparencies or for overhead projection, or may be laminated to another material support and/or protection. Also, as above indicated, development mechanisms not using toner can be utilized such as differential wetting with subsequent lithographic-type duplicating and heating the thin insulating film while on the charge bearing surface to dimple the film in areas of electrostatic charge followed by cooling to freeze the image. The latter process is particularly applicable to certain, known heat resistant photoconductive surfaces and to other charge bearing surfaces.

The invention also contemplates the use of a toner-imaged thin insulating film as a master substrate in a further duplication process in which the toner image may be transferred in whole or in part to another surface. In the latter process, the toner particles can include alcohol soluble dyes for use in a subsequent spirit duplication process.

We claim:

1. Apparatus for electrostatic reproduction of multiple copies from a single exposure, comprising:

a member having a photoconductive surface adapted for bearing an electrostatic charge and for having an electrostatic image formed thereon as a result of selective radiative discharge by predetermined radiation;

means for applying a substantially uniformly distributed electrostatic charge on said photoconductive surface;

a single thin insulative member having a thickness of from about 0.1 mil to about 3.0 mils, a resistivity of at least $10^{13}$ ohms/ of surface and sufficient transparency to said radiation for radiative discharge therethrough of said photoconductive surface;

means for applying said insulative member to said charge bearing photoconductive surface following application to said photoconductive surface of said substantially uniformly distributed electrostatic charge, with a first surface of said insulative member in direct contact with said charge bearing photoconductive surface;

means for exposing a predetermined region of said charge bearing photoconductive surface through said insulative member, to a pattern of said radiation to form an electrostatic charge image of said pattern on said photoconductive surface region, said image having a potential sufficient to effect toner-development thereof by induction through said thin insulative member but insufficient to discharge upon removal of said developed image;

means for applying toner to a second surface of said insulative member opposite to said first surface subsequent to formation of said electrostatic image and while said first surface is in said direct contact with said charge bearing surface at said region thereof to form a toner image of said pattern on said second surface adhered by attraction to the pattern of electrostatic charge on said charge bearing surface;

means for separating said insulative member from said photoconductive surface;

means for transferring said toner image from said thin insulative member to a support member; and means for reapplying said insulative member in direct contact with said photoconductive surface subsequent to transfer of said toner image for application of further toner thereto while said insulative member is in said reapplied direct contact without further electrostatically charging, and without further exposing, said photoconductive surface region for subsequent toning of and transfer of toner from said reapplied insulative member.

2. The invention according to claim 1 in which said insulative member includes a length in excess of the length of said predetermined region and including means for applying said excess length of insulative member in direct contact with said charge bearing surface at said region thereof without further formation of an electrostatic image for subsequent development of a second image on said excess length.

3. The invention accordance to claim 1 in which said insulative member includes a length in excess of the length of said predetermined region and including means for applying said excess length of said insulative member in direct contact with a second region of said charge bearing surface lateral of said first mentioned region, said image forming means being operative on said lateral region for forming an electrostatic image thereon, said toner application means and toner image transfer means being operative on said excess length of said insulative member for development of an image on said excess length.

4. The invention according to claim 1 in which said insulative member is in the form of a continuous loop.

5. The invention according to claim 1 in which said insulative member comprises a plastic film having a thickness of from about 0.25 mil to about 1.5 mils.

6. The invention according to claim 1 in which said insulative member and photoconductive surface each include a plurality of portions at least equal in total length to a corresponding plurality of the length of said predetermined region and including means for successively applying adjacent portions of said insulative member in direct contact with successive adjacent portions of said photoconductive surface, said charging means and exposing means being operative to charge and expose said successive adjacent portions of said photoconductive surface, said toner application means and toner image transfer means being operative to respectively apply toner to and transfer successive toner images from successively adjacent insulative member portions.

7. The invention according to claim 6 including means for absorbing first preselected wavelengths of radiation during exposure of a first portion of said photoconductive surface and second preselected wavelengths of radiation during exposure of a portion of said photoconductive surface adjacent said first portion.

8. The invention according to claim 7 including means for transferring said successive toner images to a single support member.

* * * * *